United States Patent [19]

Groot

[11] B 3,986,071

[45] Oct. 12, 1976

[54] RESILIENT CLAMPING MEMBERS FOR COLOR SELECTION ELECTRODE

[75] Inventor: Theodorus Cornelis Groot, Eindhoven, Netherlands

[73] Assignee: U.S. Philips Corporation, New York, N.Y.

[22] Filed: Nov. 14, 1974

[21] Appl. No.: 523,696

[44] Published under the second Trial Voluntary Protest Program on January 13, 1976 as document No. B 523,696.

[30] Foreign Application Priority Data

Nov. 30, 1973 Netherlands ..... 7316388

[52] U.S. Cl. ..... 313/404; 313/406

[51] Int. Cl.[2] ..... H01J 29/06; H01J 29/02

[58] Field of Search ..... 313/406, 408, 403, 402, 313/407, 404, 471

[56] References Cited

UNITED STATES PATENTS

| | | | |
|---|---|---|---|
| 2,939,981 | 6/1960 | Hoagland | 313/407 |
| 3,548,235 | 12/1970 | Driedijk et al. | 313/404 |

*Primary Examiner*—Robert Segal

*Attorney, Agent, or Firm*—Frank R. Trifari; George B. Berka

[57] ABSTRACT

Supporting means for a color selection electrode of a color cathode ray tube comprising metal pins sealed in the wall of the tube, and resilient clamping members secured to the electrodes and bearing upon pairs of the pins.

2 Claims, 2 Drawing Figures

RESILIENT CLAMPING MEMBERS FOR COLOR SELECTION ELECTRODE

Figure 1:
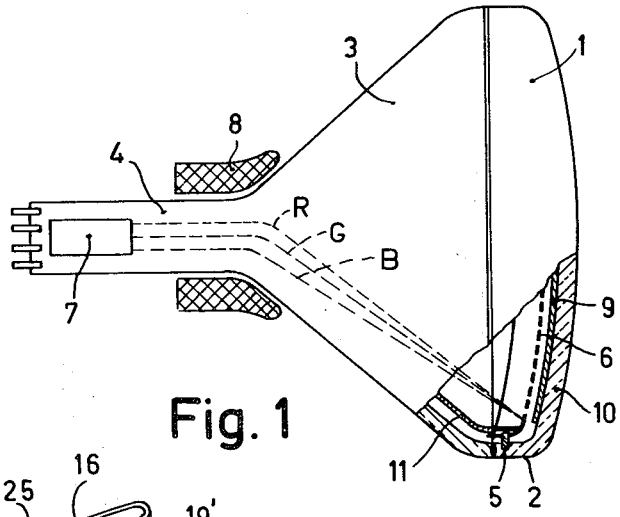

The invention relates to a cathode-ray tube for displaying color pictures of which the evacuated envelope is formed partly by a dish-shaped substantially rectangular display screen having in the upright edge thereof means to support a substantially rectangular color selection electrode suspended in the tube, which color selection electrode has a number of suspension members having at their ends which are not connected to the electrode a clamping member which is manufactured from a resilient material, said clamping member constituting a detachable clamping connection in cooperation with the said supporting means.

Such a cathode-ray tube is known from the United States Patent Specification No. 3,548,235. The means to support the color selection electrode in said specification consists of recesses provided in the upright edge of the display screen and cooperating with clamping members forming part of the suspension members of the electrode. Said cooperation consists in that upon securing the color selection electrode in the tube, the said clamping members are brought in a clamping contact with the walls of the said recesses. A problem which is difficult to avoid is that, when the clamping members are placed in their recesses or are removed therefrom surface damage can easily occur to the walls of said recesses. When during its manufacture the tube is exposed to rapid temperature changes, said surface damages may give rise to fractures of the glass window. An additional factor which contributes to said fracture is the unfavourable stress distribution which builds up in the glass notably at the area of a recess, mainly due to the changes in the wall thickness of the said upright edge which are abrupt at that area.

It is the object of the invention to provide a construction for connecting a color selection electrode in a tube and in which the said drawbacks are substantially avoided.

For that purpose, a cathode-ray tube of the type mentioned in the preamble is characterized in that the means for supporting the color selection electrode consist of supporting members which start from the upright edge of the display screen and which cooperate in pairs with a clamping member.

Said supporting members preferably consist of metal pins which are sealed in the upright edge of the display screen and which constitute two by two a clamping fit for each clamping member. The clamping member itself consists generally of a resilient material which in the pretensioned condition is placed between the supporting members. Upon inserting or removing, the clamping members do touch the supporting members but any contact with the glass wall, and hence the formation of scratches thereon, is avoided during said operation. The upright edge of the display screen does not comprise any abrupt transition as is the case in the known cathode-ray tube. At the area where the supporting members are provided in the glass wall, said glass wall may be thicker than elsewhere but the transition may take place very gradually. Stresses in the glass at the area of the supporting members can be minimized by adapting the coefficient of expansion of the material of the supporting members to that of the glass.

In order to fix the position of the clamping members in the clamped condition, according to the invention, said members comprise in places located diametrically oppositely to each other a notch or dent which cooperates with the supporting members. Furthermore, in order to avoid tilting of the clamping members, they engage the wall of the upright edge of the display screen in defined places. The forces with which the clamping member in said defined places presses against the wall are extremely small since they only should ensure a defined position of the clamping member. The actual fixation of the clamping member has been obtained by engagement of the supporting members in the said notches or dents in the clamping member.

A color selection electrode is usually secured in the tube while using a firm supporting frame. A problem in such a construction is that during the warming up period of the tube the thermal expansion of the supporting frame lags behind with respect to that of the color selection electrode, which results in color defects in the displayed picture. As is known inter alia from the above-mentioned United States patent specification the larger rigidity of the electrode near its corner points may be used by securing the suspension members to said corner points. In that case, the use of a supporting frame is no longer necessary. According to the invention, this advantage is used if the supporting members are provided at a short distance from the corners in the upright edge of the display screen, namely one on either side of each corner.

Figure 2:
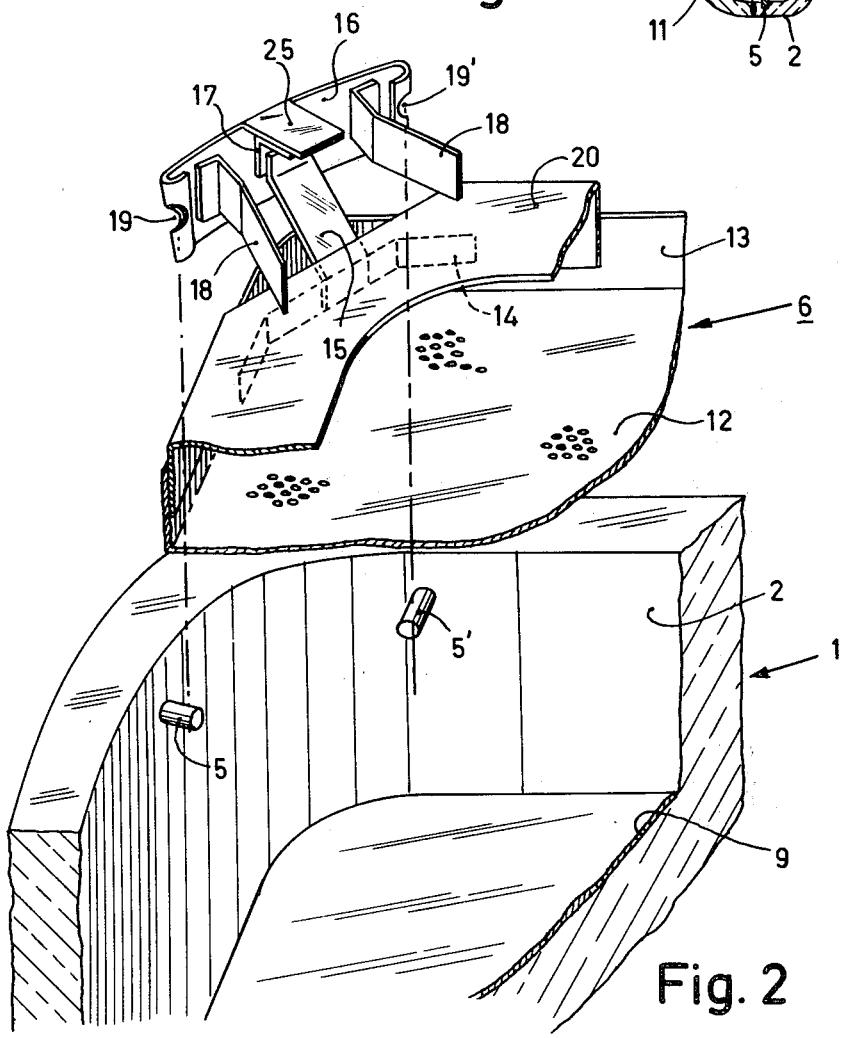

The invention will be described in detail with reference to the drawing, in which:

FIG. 1 is a partial sectional view of a cathode-ray tube for displaying colored pictures according to the invention, and FIG. 2 is a perspective exploded view of the suspension of the color selection electrode in a corner of the window shown diagrammatically in FIG. 1.

The evacuated envelope of the cathode-ray tube according to the invention shown in FIG. 1 consists of a rectangular dish-shaped glass window 1, a conical central part 3 and a glass neck 4. Near the corners in the upright edge 2 of the window there are a number of metal pins 5 to support a color selection electrode 6 suspended at a short distance from the display screen. The tube furthermore comprises an electrode system 7 for generating three electron beams R, G and B which is mounted in the neck and is shown diagrammatically in the figure. Said three beams are deflected by means of a system of deflection coils 8 placed coaxially around the tube axis and they intersect each other substantially at the area of the color selection electrode 6, after which they impinge upon a mosaic pattern 9 of phosphors luminescing in the color red, green and blue provided internally on the display screen 10 in such manner that each of the electron beams is associated with phosphor regions of one color. The electron beams are screened from the terrestrical magnetic field by means of a metal screening cap 11 extending in the conical central part.

The way in which the color selection electrode is secured in the corners of the window will be described in detail with reference to FIG. 2. The colour selection electrode 6 consists of a thin perforated plate 12 which is bounded by an upright edge 13 and is reinforced in the corners by means of a supporting strip 14. A strip-shaped supporting member 15 is secured at one end to the supporting strip 14 and at the other end to a clamping member 16 through the intermediary of an angle piece 17. The suspension member and the supporting strip may also be formed integral. After adjusting the color selection electrode 6 in the dish-shaped window, the limb of the angle piece 17 extending in the radial direction relative to the tube axis is welded to the projection 25 of the clamping member 16, while the suspension member 15 is welded to the limb of the said angle piece extending in the axial direction in such manner that the correct position of the clamping member relative to the colour selection electrode is fixed. The suspension member 15 is substantially at right angles to the electron beams deflected towards the corner in question so that in the case of a thermal expansion of the color selection electrode a correcting displacement thereof in the direction towards the display screen is obtained in a simple manner.

The clamping member 16 consists mainly of a metal strip which is bent on either side of the center and which has in said bent places a notch 19 and a notch 19'. The clamping member furthermore comprises two tensioning arms 18 by means of which it can be inserted in the pretensioned condition between the pins 5 and 5' which are sealed in the upright edge 2 of the window, said pins which are present in a plane perpendicular to the tube axis engaging in the notches 19 and 19'. In order to facilitate the insertion, the clamping member slightly tapers in the direction of the display screen. After the engagement of the pins 5 and 5' in the notches 19 and 19', the clamping member 16 slides along said pins towards the wall of the upright edge 2 until it bears against said wall in defined places. A good definition of said places is obtained by giving the clamping member at that area rounded cams. In order to exclude the minutest damage of the glass wall in said engagement places, said cams or the glass wall may be covered with a protecting material, for example graphite.

The usual firm supporting frame for the color selection electrode has been replaced by a diaphragm 20 in order to prevent reflection of the electrons at the upright edge 13 of the color selection electrode. In order to avoid temperature differences between the color selection electrode and the diaphragm during the warming-up of the tube, both are manufactured from the same material, while the thickness of the diaphragm is substantially equal to the thickness of the perforated plate 12, namely approximately 150 $\mu$m. The result is a construction which is lighter by approximately a factor 10 than that in which a firm supporting frame is used. The pins sealed in the upright edge of the display window and by which said construction is supported can be constructed to be correspondingly lighter and have only a diameter of 1.5 mm and a free length of 5 mm.

What is claimed is:

1. A color cathode ray tube including an evacuated envelope having a dish-shaped, substantially rectangular display screen and, within said envelope, a substantially rectangular color selection electrode disposed within and spaced apart from said screen, means for supporting said electrode comprising suspension members each connected at one end thereof to said electrode, elongate clamping members of resilient material each connected at its center to the free end of a corresponding suspension member and extending in a substantially transverse direction thereto, and pairs of metal supporting members sealed partly in the upright wall of said screen opposite the end portions of said clamping members and constituting two by two a clamping fit for each clamping member, said clamping members being adjusted for bearing upon and resiliently engaging the projecting ends of assigned pairs of said supporting members and abutting against the inner wall of said screen, each clamping member having at its free ends a notch which cooperates with the said supporting members.

2. A color cathode ray tube as claimed in claim 1, wherein the free end portions of said clamping members are bent inwardly.

* * * * *